US008968225B2

(12) United States Patent
Lagus

(10) Patent No.: US 8,968,225 B2
(45) Date of Patent: Mar. 3, 2015

(54) DEVICE FOR FOOT ZONE THERAPY

(76) Inventor: Pentti Lagus, Helsinki (FI)

( * ) Notice: Subject to any disclaimer, the term of this patent is extended or adjusted under 35 U.S.C. 154(b) by 363 days.

(21) Appl. No.: 13/212,586

(22) Filed: Aug. 18, 2011

(65) Prior Publication Data

US 2012/0046581 A1 Feb. 23, 2012

(30) Foreign Application Priority Data

Aug. 20, 2010 (EP) ..... 10173555

(51) Int. Cl.
*A61H 15/00* (2006.01)
*A61H 7/00* (2006.01)

(52) U.S. Cl.
CPC ..... *A61H 7/001* (2013.01); *A61H 15/00* (2013.01); *A61H 2205/125* (2013.01)
USPC ..... 601/118; 601/120

(58) Field of Classification Search
USPC ..... 601/116, 118, 119, 120, 121, 128, 134, 601/135, 122–127; 482/79, 80, 131, 132, 482/907
See application file for complete search history.

(56) References Cited

U.S. PATENT DOCUMENTS 2,045,814 A * 6/1936 Werler ..... 601/126
2,467,943 A * 4/1949 Mikell, Jr. ..... 482/79
3,565,064 A * 2/1971 Ryerson ..... 601/126
4,142,519 A * 3/1979 Ferguson ..... 601/118
6,210,349 B1 * 4/2001 Naruse et al. ..... 601/127
2005/0049533 A1 * 3/2005 Beiruti ..... 601/118
2006/0084893 A1 * 4/2006 Marten ..... 601/118
2008/0250903 A1 * 10/2008 Hsieh ..... 81/60

FOREIGN PATENT DOCUMENTS

DE 901124 U1 10/1990
DE 9209023 U1 11/1992
DE 19506393 A1 8/1995
EP 0717974 A2 6/1996
WO WO-91/04001 A1 4/1991

OTHER PUBLICATIONS

European Search Report issued in related European Application No. 10 17 3555 on Jan. 21, 2011.

* cited by examiner

*Primary Examiner* — Justine Yu
*Assistant Examiner* — Kathrynn Reilly
(74) *Attorney, Agent, or Firm* — Novak Druce Connolly Bove + Quigg LLP

(57) ABSTRACT

The invention relates to a device for foot zone therapy. The device includes a frame (1, 11), and a base (2, 12) provided with knobs (3*a*) for pressing the foot sole against. The knobs (3*a*) are laid out in an area essentially consistent with the length and shape of a foot sole. The base (2, 12) is either a rotatable roll (2) or a panel (12) divided for discrete zones (A, B, C, D), whereby rotating the roll or changing a relative height position of the zones in the flat panel enables the foot sole to be contacted alternately with various knobby zones. The device is adapted for such an operation that the effect of the knobs (3*a*) always proceeds from heel towards toes.

5 Claims, 4 Drawing Sheets

DEVICE FOR FOOT ZONE THERAPY

CROSS REFERENCE TO RELATED APPLICATIONS

This application claims priority to Application No. 10173555.3 filed in Europe on Aug. 20, 2010 under 35 U.S.C. §119, the entire contents of which is hereby incorporated by reference.

The invention relates to a device for foot zone therapy, said device comprising a frame, and a base provided with knobs for pressing the foot sole against.

Foot zone therapy has given rise to the development of a wide variety of rollers rotatable under foot soles, or knobby insoles fitted inside shoes. Publication JP 11076344 A discloses a device, which comprises reciprocatively moving a roller rotating under sheets equipped with projections, whereby the projections rise alternately when proceeding from heel towards toes and from toes towards heel. However, these prior known devices do not provide a proper zone therapy that concentrates on correct pressure points alternately over the entire foot sole area in a correct zone sequence from the heel towards the toes.

BRIEF SUMMARY OF THE INVENTION

It is an object of the invention to provide a zone therapy device that enables eliminating the above-discussed shortfall.

This object is achieved by the invention on the basis of the characterizing features presented in the appended claim 1. Preferred embodiments of the invention are presented in the dependent claims.

Figure 1:
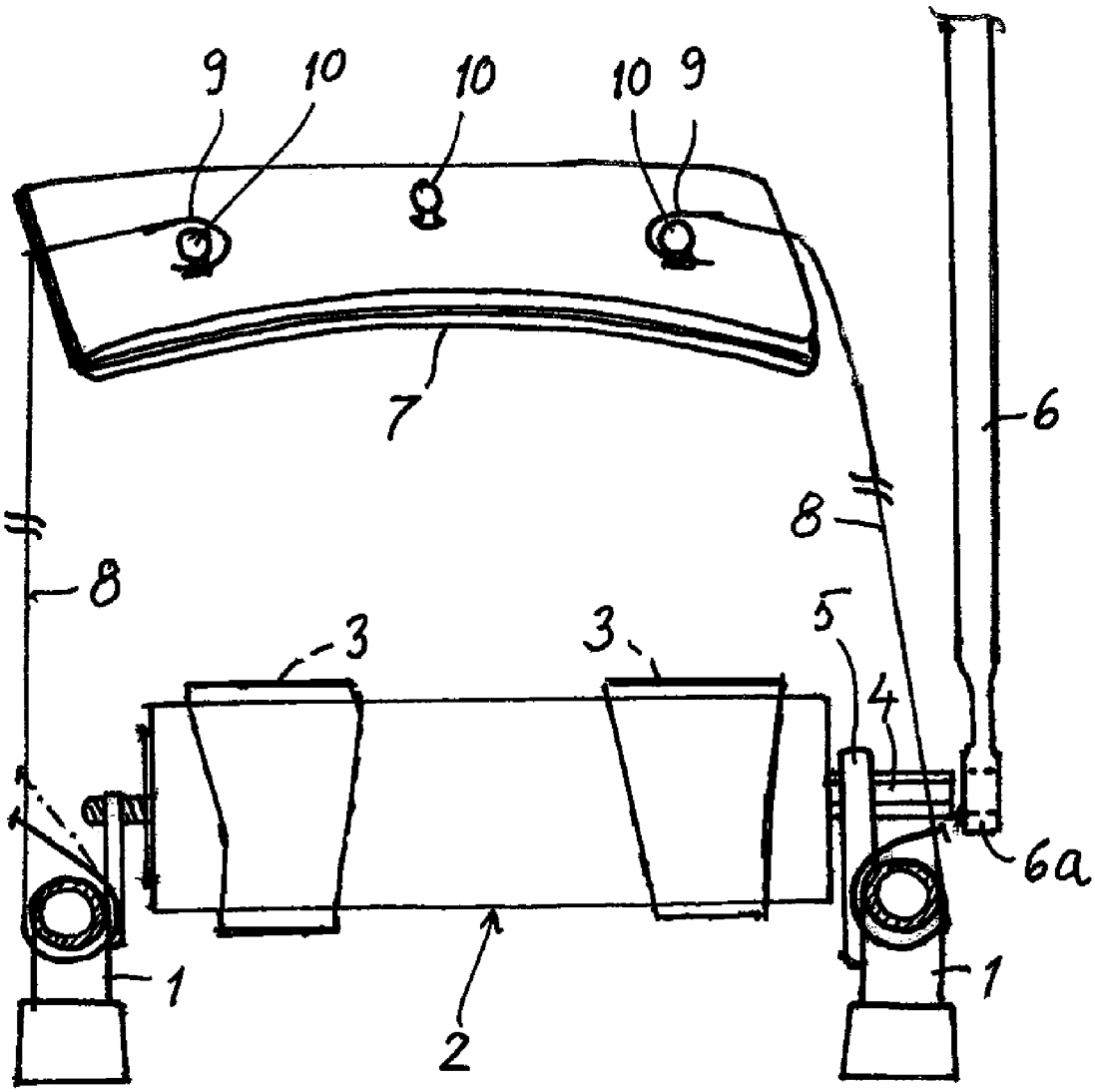
Figure 2:
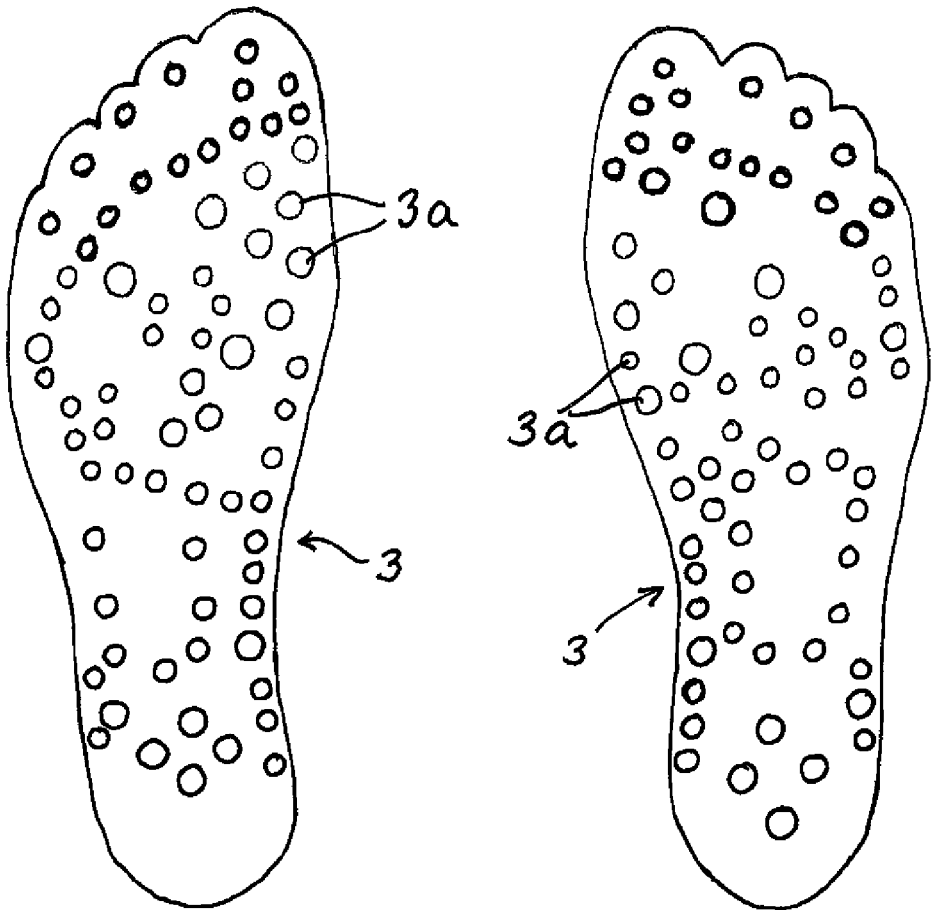
Figure 3:
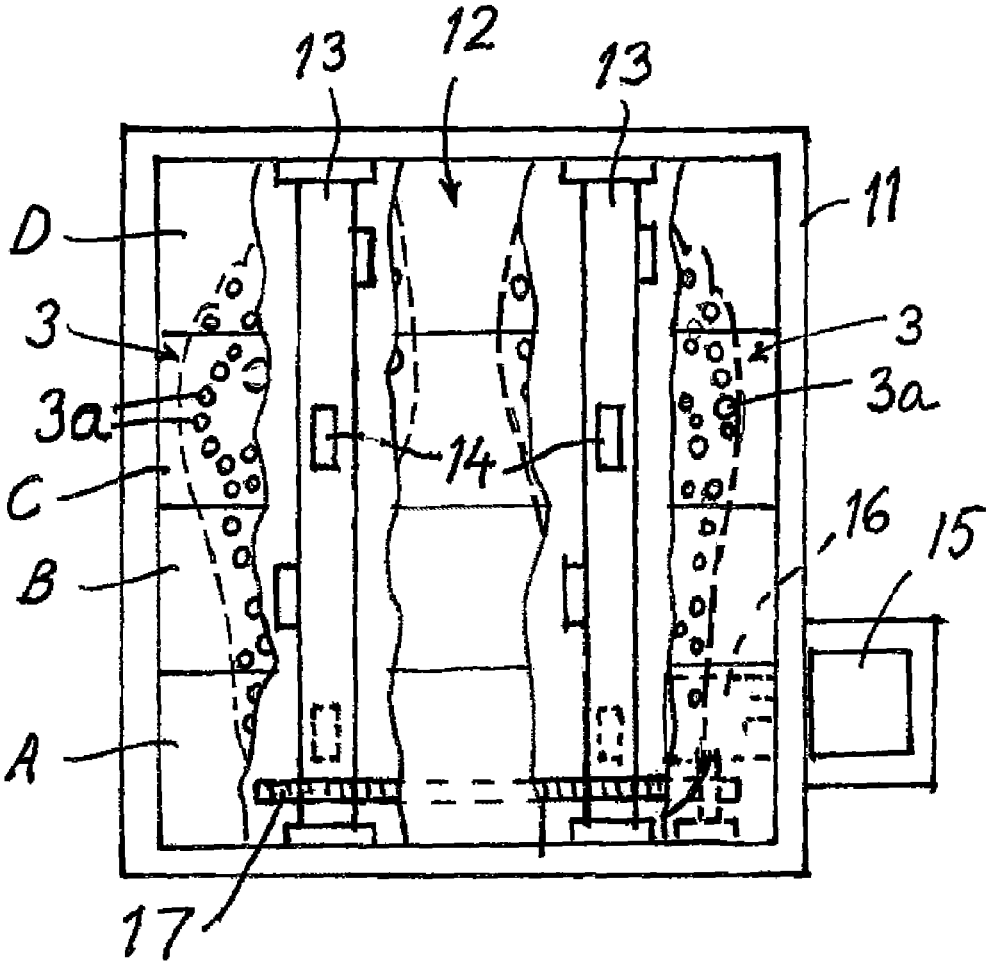
Figure 4:
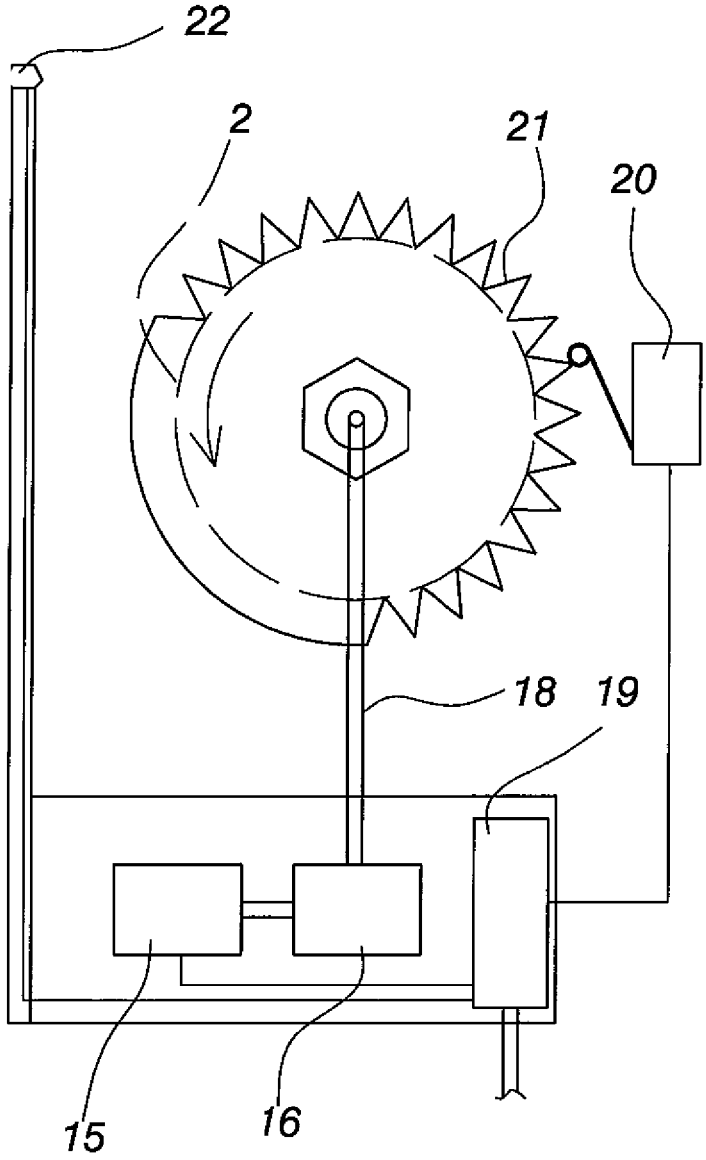

The invention will now be described in more detail with reference to the accompanying drawings, in which FIG. 1 shows a zone therapy device according to a first embodiment of the invention, FIG. 2 shows an example of the layout of knobs over the area of foot soles on sole-shaped flexible sheets or mats, which are interchangeably fastenable, e.g. with Velcro attachment, to devices according to various embodiments of the invention;

FIG. 3 shows a zone therapy device according to a second embodiment of the invention in a partially bottom cutaway view; and FIG. 4 shows a zone therapy device according to a third embodiment of the invention schematically in a side view.

The device of FIG. 1 includes a frame 1, on which is bearing-mounted a roll 2 capable of rotating in just one direction and provided with knob sheets 3 as shown in FIG. 2, against which a sole of the foot can be pressed. The roll 2 has a diameter within the range of 8-13 cm. Knobs 3*a* are laid out on the roll in its circumferential direction over a distance substantially matching the sole of foot in length. The roll 2 is bearing-mounted for one-way rotation by having an axle 4 of a polygonal cross-section fitted inside a ring 5, which is bearing-mounted with a ratchet mechanism for one-way rotation. Such a ratchet mechanism ring is known e.g. from screw spanners. Onto the end of the hexagonal axle 4 can be pushed a second ratchet ring 6*a* present at the root of an operating lever 6. The lever 6 extends to the hand of a user, whereby the user is able to rotate the roll 2 over a desired distance in one direction by working the lever.

The device also includes a brace 7, which can be set on top of the knees and which is e.g. a padded plate. The brace 7 is connected by tightening belts or bands 8 to the frame 1. The belts or bands 8 can be at least partially rubber bands and can be adjustable in length, whereby the distance between the roll

2 and the brace 7 can be adapted to the length of a user's shin for pressing the foot soles with a suitable compressive force against the knobs 3*a* of the roll 2. By increasing a clamping force of the tightening belts 8 as exercises advance, a progressive effect is achieved. No individual knobs are sketched in FIG. 1, but a dashed line is used to depict the area in which the knobby sheets or mats of FIG. 2 are attached. The roll 2 can be made e.g. in wood, and the knobby sheets or mats 3 can be of plastics with catching hooks on their back surface for Velcro attachment. A Velcro attachment substrate can be attached to the roll 2 by gluing. Hence, the knobby sheets or mats 3 matching a different foot size can be interchanged without changing the roll 2. Alternatively, the knobs can be wooden pegs, which are secured in holes drilled in the roll 2. Drilling the holes can be facilitated by using perforation templates consistent with FIG. 2, whose holes match the knobs 3*a* in terms of the layout and diameters thereof. The knobs 3*a* may come e.g. in three different diameters, whereby larger knobs are typically adapted to extend to a slightly higher level than smaller knobs. The knobs varying in size and height are laid out as determined by the response zones of therapeutic points. The left and right foot knob patterns are different from each other.

Hooks 9 at the ends of the tightening belts 8 can be secured to fasteners 10 on top of the brace plate 7. The use of various fasteners 10 further offers additional adjustment for the length of the tightening belts 8 (rough basic adjustment).

The exemplary embodiment of FIG. 3 differs from that of FIG. 1 principally in the sense that a rotatable roll has been replaced with a flat base 12, which is divided for zones A, B, C, D. Thus, by changing a mutual height level of the base zones, the sole of a foot is can be contacted with various knobby zones the same way as done in the exemplary embodiment of FIG. 1 by rotating the roll. This is important for enabling the effect of the knobs 3*a* to proceed zone by zone from heel towards toes as the device is operated. This has the most favorable effect on the nerves and circulation of a user's feet as the stimulation proceeds along the natural working direction of neural pathways.

The base 12 has its zones adapted to be raised one after the other by means of rotatable axles 13 provided with eccentric cams 14 at every zone A, B, C, D. In the illustrated case, the eccentric cams 14 have a 90° relative offset between various zones, whereby a single rotation of the axle 13 results in all of the zones being raised one by one from the plane of other zones. The axles 13 are rotated by means of an actuator 15 through the intermediary of a gear 16 and a drive belt or chain 17. The actuator 15 can be an electric motor or a manually operated lever, such as the lever 6 in FIG. 1.

In both embodiments, the base 2, 12 is provided with the knobs 3*a* in areas consistent with the patterns of two side-by-side foot soles. The base can be replaceable, and the device may come with a number of bases in which the knobs 3*a* are laid out consistently with various size foot soles. The base panel 12 can be straight or arcuate.

FIG. 4 depicts how the device of FIG. 1 is converted for automated operation. The roll 2 is rotated intermittently in one direction by a motor 15 through the intermediary of a gear 16 and a shaft 18. The motion distance of rotation cycles is determined by the pitch of teeth 21 on a gear ring mounted on the end of the roll 2, and the time gap, e.g. 10 s, is determined by an electronic time delay circuit 19. Once the delay time has lapsed, the roll 2 rotates until a micro switch 20, which is operated by the teeth 21 of the roll end-mounted gear ring, controls a relay to bring the motor 15 to a standstill for the duration of a prescribed delay time. Once the delay time has lapsed, the motor 15 is re-activated by the relay for another rotating motion of the roll 2. The number of teeth is e.g. 15 to 30, whereby the treatment cycle is accordingly e.g. 150 to 300 s+rotation time. Hence, it is the pitch of the teeth 21 which determines the size of each angle of rotation.

This electrically operated device provides a therapeutic treatment based on electronically controlled timing, which facilitates and ensures the achievement of a good result. The operation consistent with a predetermined program creates the effectiveness of treatment.

The device repeats treatment cycles until power is cut off by a switch 22, the roll 2 being controlled by electronics for rotation to the initial position, after which the power is switched off. Alternatively, a return to the initial position may occur as the device is activated by means of the switch 22.

The invention claimed is:

1. A device for foot zone therapy, said device comprising:

a frame;

a rotatable roll;

an interchangeable sheet wrapped around said rotatable roll and provided with a plurality of knobs configured to press against a foot sole, and positioned in locations having a collective outer periphery defining a shape generally consistent with a size and a shape of the foot sole;

whereby rotating the rotatable roll is configured to bring a sub-set of the knobs into contact with a sub-portion of the foot sole, while separating remaining knobs from other portions of the foot sole;

wherein the rotatable roll is configured to rotate on the frame intermittently and in just one direction, the direction of rotation being such that, as the device is operated, the effect of the peg knob proceeds from heel towards toes, but not in the reverse direction; and a brace attached to the frame with tightening bands, configured to engage over a knee and to drive the loot sole toward the rotatable roll;

wherein the rotatable roll is configured to move the foot sole from heel to toe during rotation;

wherein the device is provided with a lever configured to extend from an axle of the rotatable roll to the hand of a user, the back and forth working of which rotates the rotatable roll in just one direction of rotation.

2. A device as claimed in claim 1, wherein the sheet is provided with the knobs in areas consistent with the patterns of two side-by-side foot soles, and that knobs of various sizes and heights are laid out in compliance the response zones of therapeutic points.

3. A device as claimed in claim 1, wherein the rotatable roll has a diameter of 8-13 cm.

4. A device as claimed in claim 2, wherein the rotatable roll has a diameter of 8-13 cm.

5. The device of claim 1, where the interchangeable sheet is mounted on, wrapped around and has an axis of rotation coaxial with said rotatable roll.

* * * * *